US005287813A

United States Patent [19]

Hänni et al.

[11] Patent Number: 5,287,813

[45] Date of Patent: Feb. 22, 1994

[54] COACH BODY CONSTRUCTION FOR RAIL VEHICLES HAVING EXTRUDED ALUMINUM PROFILES WITH UNDERCUT NUT-RECEIVING GROOVES FOR EASE OF ASSSEMBLY

[75] Inventors: Roland Hänni, Zürich; Alex Stutz, Hirzel; Giorgio Destefani, Zürich, all of Switzerland

[73] Assignee: Alusuisse-Lonza Services Ltd., Zurich, Switzerland

[21] Appl. No.: 716,631

[22] Filed: Jun. 17, 1991

[30] Foreign Application Priority Data

Jun. 7, 1990 [CH] Switzerland ..... 2256/90

[51] Int. Cl.[5] ..... B61D 17/04

[52] U.S. Cl. ..... 105/396; 105/397; 105/399; 105/407; 105/418; 296/203; 296/204; 296/205; 296/29; 52/732.2

[58] Field of Search ..... 105/396, 397, 399, 401, 105/404, 407, 409, 414, 418, 419; 296/203, 204, 205, 29; 52/730, 731

[56] References Cited

U.S. PATENT DOCUMENTS

| | | | |
|---|---|---|---|
| 2,036,555 | 4/1936 | Thompson et al. | 105/401 |
| 2,197,708 | 4/1940 | Ragsdale et al. | 105/399 |
| 2,223,667 | 12/1940 | Mussey | 105/409 |
| 2,697,990 | 12/1954 | Parsons et al. | 105/399 X |
| 2,926,618 | 3/1960 | Nelson et al. | 105/396 X |
| 4,230,361 | 10/1980 | Nachbur et al. | 296/193 |
| 4,231,207 | 11/1980 | Kern et al. | 52/730 |
| 4,357,048 | 11/1982 | Zehnder et al. | 296/183 |
| 4,395,862 | 8/1983 | Jager et al. | 52/731 |
| 4,662,650 | 5/1987 | Angehrn et al. | 280/789 |
| 4,852,937 | 8/1989 | Lemieux | 296/99 X |
| 5,085,485 | 2/1992 | Wurl | 296/205 X |

FOREIGN PATENT DOCUMENTS

| | | | |
|---|---|---|---|
| 3242984 | 8/1984 | Australia . | |
| 3757485 | 1/1985 | Australia . | |
| 0136264 | 4/1985 | European Pat. Off. . | |
| 186625 | 7/1986 | European Pat. Off. | 296/207 |
| 0302017 | 2/1989 | European Pat. Off. . | |
| 1603258 | 3/1971 | France . | |
| 37123 | 4/1959 | Luxembourg . | |
| 673111 | 2/1990 | Switzerland | 105/397 |
| 87/04679 | 8/1987 | World Int. Prop. O. | 296/203 |
| 90/04534 | 5/1990 | World Int. Prop. O. . | |

OTHER PUBLICATIONS

Schweizer Aluminium Rundschau, vol. 16, No. 2, Mar. 1966, p. 49.

*Primary Examiner*—Robert J. Oberleitner
*Assistant Examiner*—S. Joseph Morano
*Attorney, Agent, or Firm*—Bachman & Lapointe

[57] ABSTRACT

The coach body construction comprises an upper structure having extruded profiles, which are connected detachably to one another by corner connectors and are made of an aluminum alloy, and a lower structure. The lower structure is composed of longitudinal and transverse supports which are made of an extruded aluminum alloy and are detachably connected to one another and to the upper structure by corner connectors. In interaction with the upper structure, it is of inherently sturdy construction. The corner connectors are, in particular, screw-on corner connectors.

23 Claims, 2 Drawing Sheets

1
2
3
4
5
6
7
8
15
16
17
18
19
22
23
32
33
34
35
E
E'
E''
F
T

COACH BODY CONSTRUCTION FOR RAIL VEHICLES HAVING EXTRUDED ALUMINUM PROFILES WITH UNDERCUT NUT-RECEIVING GROOVES FOR EASE OF ASSSEMBLY

BACKGROUND OF THE INVENTION

The invention relates to a coach body construction for rail vehicles which comprise an upper structure having extruded profiles, which are connected detachably to one other by mechanical means and are made of an aluminum alloy, and a lower structure.

It is known and customary to design the lower structure of a coach body for rail vehicles as a welded steel construction having longitudinal and transverse supports and, by means of screw connections, to attach thereto an upper structure made of posts, upper flanges and, if need be, roof arches. Although the lower structure made of a welded steel construction is self-supporting per se, a part of the stability of the coach body construction can be taken over by a rigid upper construction. A coach body construction of this type for road and rail vehicles is disclosed, for example, in European Patent 0,031,306.

European Patent 0,186,625 describes a chassis for road vehicles, in particular made of an aluminum alloy, having longitudinal supports and transverse supports passing through said longitudinal supports, and an outer frame to receive floor planks extending in the longitudinal direction. The profiles are screwed to one another by means of corner pieces. The chassis must be designed to be self-supporting in itself, otherwise it could not be used as a loading ramp of road vehicles. However, this solution, conceived for a chassis for road vehicles cannot be transferred to rail vehicle construction because, in that case, different conditions prevail and there are different requirements.

SUMMARY OF THE INVENTION

The underlying object of the present invention is to provide a coach body construction for rail vehicles of the type described above, which coach body construction achieves the stability necessary for rail vehicles with small outlay, has a low weight and is easy to repair.

The object is achieved according to the invention in that the lower structure is composed of longitudinal and transverse supports which are made of an extruded aluminum alloy and are detachably connected to one another and to the upper structure by mechanical means, which lower structure, in interaction with the upper structure is of inherently sturdy construction. Special embodiments and further developments will be described hereinbelow.

The mechanical means for the connection of the profiles are preferably screw-on corner connectors with screw holes in both limbs. Reference is made to German Patent 2,751,753 and Swiss Patent Applications 01246/90 and 02014/90 concerning further details of the corner connectors with clamping plates which are known per se.

In respect of the desired rigidity of the coach body construction which is to be as high as possible with low profile cross-sections, it has proved to be advantageous for the longitudinal supports and at least some of the transverse supports of the lower structure and the posts and upper flanges of the upper structure to have on at least one side two undercut longitudinal grooves for receiving nuts, preferably rotatable clamping plates, or clamping straps with transverse webs.

The longitudinal grooves mentioned, which are preferably arranged spaced apart, are formed in cross-section essentially by C-shaped profile fittings. According to a preferred variant, the corner pieces can thus be placed in the undercut grooves of the profiles to be connected with clamping plates positioned in the longitudinal direction of the two limbs and the screws, screwed into the clamping plates, can be tightened using a screwdriver, spanner or the like. In this case, the clamping plates rotate by 45° and, after the screws have been tightened, guarantee a secure, sturdy connection (German Patent 2,751,753).

For the transmission of relatively large bending moments via the corner pieces having rotatable clamping plates, corner connectors are composed of two corner pieces which can be moved relative to each other and which each have a groove along their limbs, resting on the profiles to be connected, on the side facing away from the complementary corner piece and a wedge surface on the opposite side. Both profiles have on each of the two profile limbs a second web parallel to the first web. The latter engage positively in the grooves of the corner pieces. The corner pieces are spread apart by at least one wedge rail in each case which rests on the wedge surfaces and is tensioned by screws against the associated profile (European Patent Publication A1 0452256).

According to a second preferred variant, the corner connectors are fixed by clamping straps in the longitudinal grooves formed by the C-shaped profile fittings. The clamping straps are introduced with inserted screws into the longitudinal groove. The strips of the C-shaped profile fittings, bounding the opening of the longitudinal grooves, each have a thickening on the inside. The clamping strap has on each side a longitudinal bead gripping behind the thickenings and on each side of the screw at least one transverse web which presses into the thickening of the respective strip when the screw is tightened. This permits a great use of force in the longitudinal direction of the profile (European Patent Publication A1 0462058).

With a coach body construction for rail vehicles which has a basic frame made of screwed-together aluminum profiles, not only can the costs be lowered, but the flexibility is also higher because the method of module construction can be used and all the mechanical connections are detachable. The lower structure only has to form a coach body, which is inherently sturdy, in interaction with the upper structure.

With the coach body construction according to the invention, material and working costs can be saved and the operating costs can be reduced considerably, which is particularly significant due to the long service life, because a low tare weight is capable of substantially lowering the drive power to be produced during start-up.

The posts of the side walls and, if appropriate, also the arches of the roof are preferably of two-part design and are composed of extruded profiles which are made of an aluminum alloy and are connected to one another via at least two webs. The width of the connection webs is coordinated with the lateral offset of the two respective longitudinal grooves in the lateral longitudinal supports and in the upper flange.

The connection webs are composed of a material of high mechanical strength, in particular a plastic, such as, for example, polyethylene or polypropylene. If no insulation properties have to be met, the connection webs can also be composed of an aluminum alloy.

The hollow spaces in the extruded profiles, in particular the side posts, can be filled with foam, eg. with a polystyrene foam. Thus the droning, felt to be a nuisance, in rail carriages can be reduced considerably.

BRIEF DESCRIPTION OF THE DRAWINGS

The invention is explained in greater detail with reference to exemplary embodiments illustrated in the diagrammatic drawing, in which.

DETAILED DESCRIPTION

Figures 1, 4, 5A, 5B:
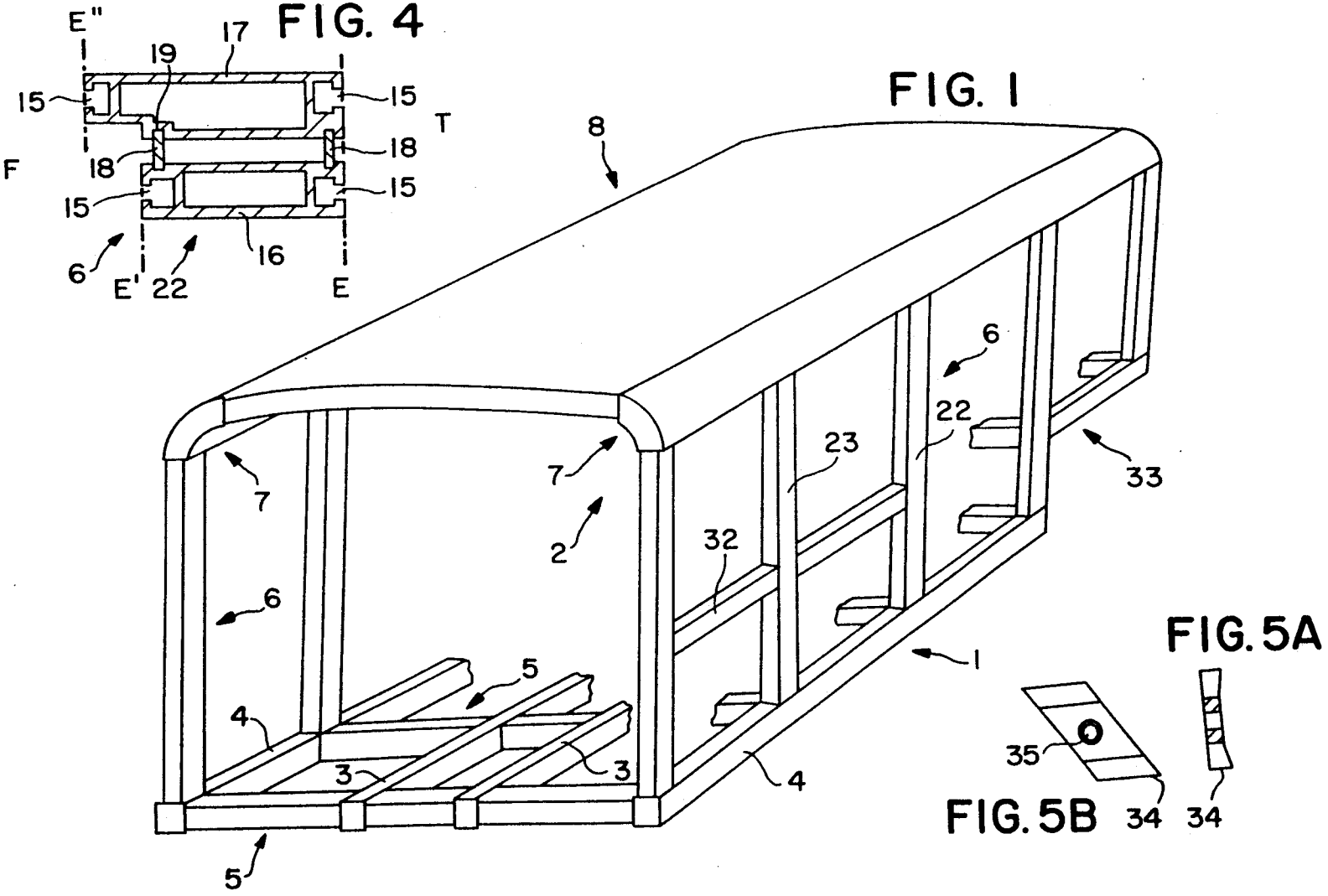
FIG. 1 shows a perspective view of a coach body.
FIG. 4 shows a cross-section through a post along the line IV—IV of FIG. 3, and FIGS. 5B and 5A show a front view and a lateral view of a clamping plate of the corner connector.

The coach body construction illustrated in FIGS. 1 to 4 has been conceived for passenger transport in local rail transport. It is essentially composed of a lower structure 1 and an upper structure 2 made of extruded aluminum profiles which are screwed together with corner connectors 13, 24, 25. This results in an at least partially modular construction, with the result that a construction can be transferred without great outlay with the same basic elements to vehicles of different length, width or height.

The lower structure 1 comprises two inner longitudinal supports 3 and two outer longitudinal supports 4, which are continuous extruded profiles, and transverse supports 5. The upper structure comprises posts 6, an upper flange 7 on each side and a roof 8.

The inner longitudinal supports 3 also serve for transmitting the buffer forces and are of comparatively solid construction. They are essentially composed of a rectangular hollow profile having on each side two undercut grooves 12 which are formed by C-shaped profile fittings in respect of the cross-section. On each side, two grooves 12 have a common central web 11.

A corner connector 13 rests on each undercut longitudinal groove. The resting surface of two adjacent longitudinal grooves 12 lie on a common plane E. The screws 14 with clamping plates 34 illustrated in FIGS. 5A and 5B are only indicated.

The narrow longitudinal sides of the longitudinal support 3, which have no grooves, are of reinforced construction, which increases the flexural strength.

The transverse supports 5, constructed as rectangular tubes, are arranged spaced apart extending in parallel. They are attached by corner connectors 13 to two adjacent longitudinal profiles 3, 4 or 3, 3.

The corner connectors 13, which are not illustrated in greater detail and are known per se, are, for example, solid sheet pieces, bent at right angles, or corresponding drop-forged shaped parts.

By the arrangement of two adjacent, undercut longitudinal grooves 12, the stability and the operational reliability can be increased.

The outer longitudinal support 4, which forms the transition from the lower structure 1 to the upper structure 2, has, in addition to the two longitudinal grooves 12 for fixing the transverse supports 5, two further longitudinal grooves 15 which are open at the top. The latter correspond to the longitudinal grooves 12, but the wall thickness can be designed to be smaller. Furthermore, the longitudinal grooves 15, which are offset laterally and in height, have a connecting web 20. The outer longitudinal groove 15 lies at a lower level than the inner one. This is not only beneficial to increased rigidity, but it also facilitates the mounting of a protective outer cover.

The posts 6, screwed to the outer longitudinal supports 4 via corner connections 24, comprise two essentially rectangular, extruded hollow profiles 16, 17 which are connected by webs 18 of low thermal conductivity made of polyethylene (FIG. 4). The connecting webs 18 are inserted and braced in correspondingly shaped longitudinal grooves 19 of both profiles. The arrangement of the connecting webs 18 in the outer region also permits a closure of the gap between the profiles 16, 17.

Both the inner and the outer profiles 16, 17 of the post 6 have undercut longitudinal grooves 15, arranged at the same distance from both narrow sides as the longitudinal supports 4 on their upper side.

At the upper flange 7, the inner profile 16 projects in terms of level over the outer profile 17 of the post 6. The planes are denoted as E' for the inner profile and E'' for the outer profile. On these two height-displaced planes, the corner connectors 24 rest on the corresponding undercut longitudinal groove 15. The planes E''and E'' drawn in on the upper flange 7 are drawn in dashed lines analogously on the outer longitudinal support 4.

Figures 2, 3:
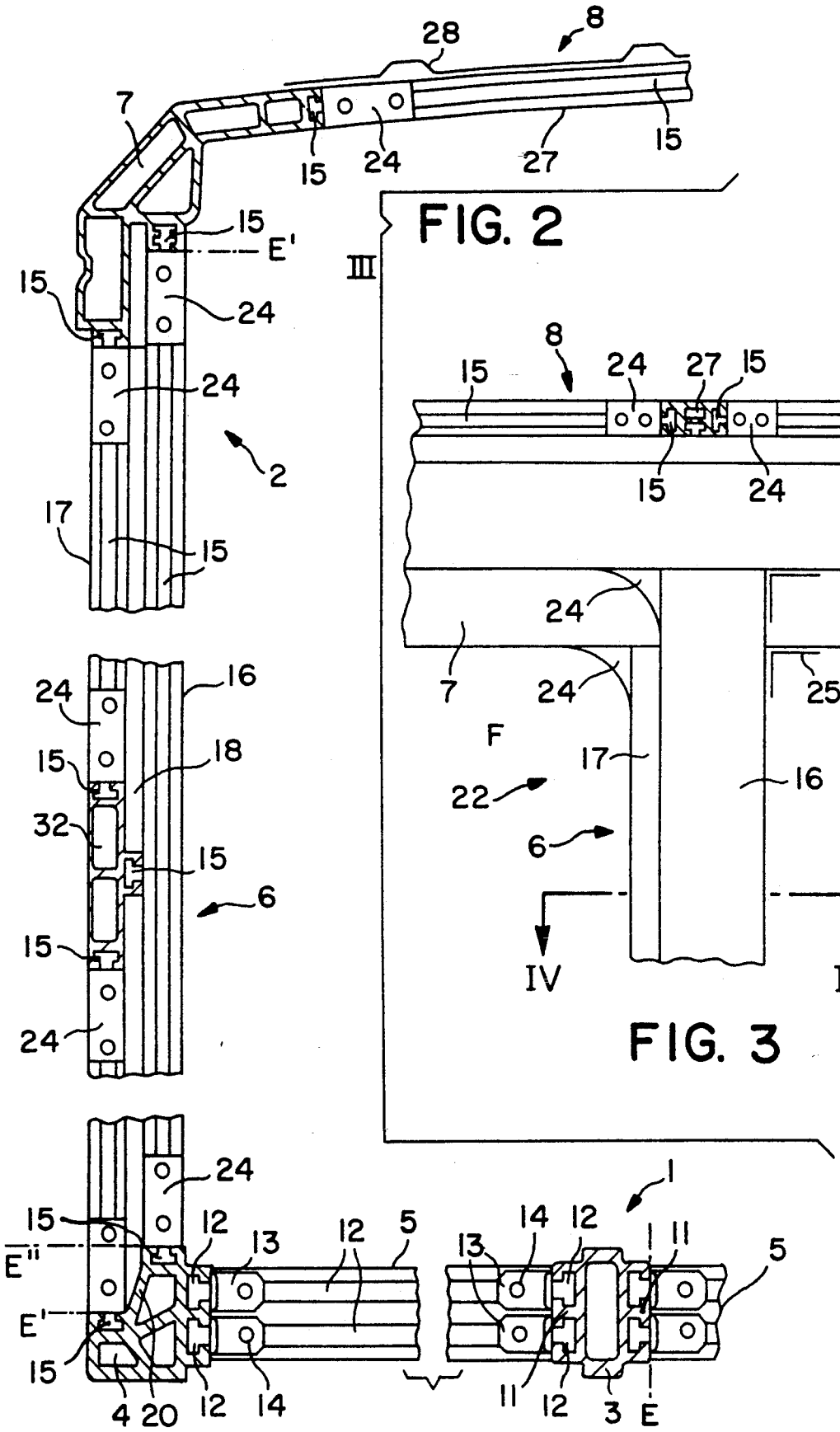
FIG. 2 shows a partial cross-section along a post through the coach body of FIG. 1.
FIG. 3 shows a view in the direction III of FIG. 2.

The post 6 illustrated in FIGS. 3 and 4 is a door/window post 22. The two longitudinally extending grooves 15 are arranged on the door side T in such a way that the corner connectors 25 can be placed on the same plane E. In contrast, on the opposite window side F, the outer profile 17 projects over the inner profile 16 in the longitudinal direction of the coach. The placed-on corner connectors 24 are thus screwed on on different planes E' and E''. The offset in height of the corner connectors 24 on the upper flange 7 enhances the stability and the lateral offset of the corner connectors 24 on the window side F of the door/window post 22 facilitates the inner construction without contributing substantially to better stability.

In the case of posts 23 (FIG. 1) which bound windows oh both sides, the outer profile 17 projects over the inner profile 16 on both sides.

The upper flange 7, constructed as a bent hollow profile, has to take on a substantial part of the bending moments of the coach body construction. The two upper flanges 7 are connected to each other via the arches 27 which also function as roof supports.

According to the embodiment according to FIG. 2, the upper flange 7 has only one undercut groove 15 formed which serves the screw connection to an arch 27. The clamping plates (not shown) of a corner connector 24 engage in the groove 15 of the upper flange 7 and a longitudinal groove in the arch 27.

The connection between the upper flange 7 and the roof arches 15 can be designed to have far greater flexural strength in that, analogously to the outer longitudinal profile 4, two adjacent longitudinal grooves 15 are formed and the roof 8 comprises two arches 27 which are located one above the other, if appropriate, connected by webs.

A roof skin 28, covering the arches 27 and a part of the upper flange 7, made of a corrugated strip is bonded to the base.

As illustrated in FIG. 3, the corner connectors 24 in the window region F are drop-forged corners, eg. corresponding to German Patent 2,751,753. In the door region T, the corner connectors 25 are L-shaped parts which require as little room as possible.

In the region below the windows, central flanges 32 are inserted between the posts 6. At the top and bottom these each have an undercut longitudinal groove 15 and they are screwed to the outer profile 17 by means of corner connectors 24. A further undercut groove 15, which can serve, for example, for the attachment of seat rests, projects from the central web 32 towards the interior of the coach.

The parallelogram-type clamping plate 34 shown in FIGS. 5A and 5B has angles of 45 and 135°. After insertion into a longitudinal groove, the plates are swivelled through 90° when the screws 14, screwed into the borehole 35 with an internal thread, are tightened (FIG. 2); they strike against the side walls of the longitudinal groove 12, 15 and can be clamped fixedly. The anchorage is improved by the convex design of the side, drawn towards the profile, of the clamping plates 34, which creates a toothing.

The design according to the invention of the coach body construction is extremely adaptable and versatile in construction. With few standard profiles it permits diverse variations of the coach body construction. By virtue of the double design of the undercut longitudinal grooves, the carcass is very resistant to twisting. The offset of the corner connectors 24 on the posts 6 and, if any, the arches 27 in two directions contributes substantially thereto because the pair of forces formed in the case of bending stress are thus spaced far more widely apart and, consequently, substantially lower forces occur with the same moment.

The coach body construction is self-supporting due to the interaction of the lower structure 1 and the upper structure 2 and only requires special reinforcements, if at all, in the region of an offset 33 in height for the installation of a rotary frame.

Due to the high flexural strength of the connection points, the coach bodies can be designed as tubes open on both sides without reinforcements being required at the end faces. As the bending moments are absorbed by the upper flanges 7, the longitudinal supports 3, 4 and transverse supports 5 of the lower structure 1 require only a small constructional height, with the result that the floor lying above it can be arranged to lie very low. Thus alighting is made considerably easier.

What is claimed is:

1. A coach body construction for a rail vehicle, said coach body construction comprising:

a lower structure including longitudinal supports and transverse supports detachably connected together;

said longitudinal supports for said lower structure comprising at least one inner support and at least two outer supports;

each said inner support comprising an extruded aluminum alloy profile having two undercut longitudinally extending grooves along at least one side;

each said outer support comprising an extruded aluminum alloy profile having at least two undercut longitudinally extending grooves along at least one side;

each said transverse support comprising an extruded aluminum alloy profile having at least two undercut longitudinally extending grooves along at least one side;

means for detachably connecting said supports together to form said lower structure, said connecting means comprising nut means received in each of said longitudinally extending grooves, corner connection means having limbs and screw holes, said corner connection means being positioned externally of each of said longitudinally extending grooves and between adjacent ones of said longitudinal and transverse supports extending substantially perpendicular to each other, and screw means for detachably connecting a respective one of said corner connection means to a respective one of said nut means within said longitudinally extending grooves.

2. The coach body construction of claim 1 further comprising an upper structure connected to said lower structure.

3. The coach body construction of claim 2 further comprising said upper structure including a plurality of posts connected to said outer supports and each of said posts having on at least one side two undercut longitudinal grooves.

4. The coach body construction of claim 3 further comprising:

each said post comprising two vertically extending, extruded profiles joined together by vertically extending web structures; and each of said vertically extending profiles having an undercut vertically extending groove along two opposed sides.

5. The coach body construction of claim 4 further comprising:

an outer one of said profiles forming each said post being wider than an inner one of said profiles forming each said post.

6. The coach body construction of claim 4 further comprising the vertically extending grooves along a first edge of each said post lying in the same plane and the vertically extending grooves along a second edge of each said post being offset relative to each other.

7. The coach body construction of claim 3 wherein:

said at least two undercut longitudinally extending grooves in each said outer support includes two offset, undercut longitudinally extending grooves along an upper surface; and at least one of said posts being connected to each of said outer supports by corner connecting means positioned externally of said offset grooves in said outer support and externally of vertically extending grooves on opposed sides of said at least one post, nut means positioned within said offset and vertically extending grooves, and screw means joining respective ones of said corner connecting means and said nut means.

8. The coach body construction of claim 7 further comprising:

a first one of said vertically extending profiles forming each said post being offset from a second one of said vertically extending profiles.

9. The coach body construction of claim 3 further comprising:

said upper structure further including arches composed of aluminum profiles connected to respective ones of said posts by upper flanges.

10. The coach body construction of claim 3 wherein the web structures are composed of a heat-insulating material.

11. The coach body construction of claim 10 wherein the web structures are inserted and braced in vertically extending grooves in said vertically extending profiles.

12. The coach body construction of claim 3 wherein said two undercut longitudinally extending grooves of each said inner support have a common central web, said at least two undercut longitudinally extending grooves in said outer and transverse supports have a common central web, and said two undercut longitudinal grooves in said posts have a common central web.

13. The coach body construction of claim 1 wherein at least some of said supports have said longitudinally extending grooves lying in the same plane along said at least one side and two additional longitudinally extending grooves offset relative to each other along a second side.

14. The coach body construction of claim 1 wherein at least some of said extruded profiles are hollow and filled with foam.

15. The coach body construction of claim 1 wherein each of said longitudinally extending grooves is formed by cross-sectionally C-shaped profile fittings.

16. The coach body construction of claim 1 wherein said nut means comprises parallelogram-type clamping plates.

17. The coach body construction of claim 1 wherein each said inner support comprises a central hollow extruded aluminum alloy profile having said two undercut longitudinally extending grooves along a first side and two additional undercut longitudinally extending grooves along a second side opposed to said first side.

18. A coach body construction for rail vehicles which comprises:

an upper structure of inherently sturdy construction including posts and upper flanges;

said posts and said upper flanges being formed by extruded aluminum alloy profiles;

said posts and said upper flanges each having two undercut longitudinally extending grooves for receiving nuts extending along at least one side;

a lower structure detachably connected to said upper structure;

said lower structure including longitudinal and transverse supports;

each of said longitudinal and transverse supports being formed by an extruded aluminum alloy profile; and each of said longitudinal supports and at least some of said transverse supports having two undercut longitudinally extending grooves extending along at least one side for receiving nuts and to provide rigidity to the coach body construction.

19. The coach body construction of claim 18 further comprising:

corner connection means for detachably and mechanically connecting said posts to said upper flanges, said longitudinal supports to said transverse supports and said posts to at least some of said longitudinal supports; and said corner connection means being screw-on corner connections having at least one limb and screw holes in said at least one limb.

20. The coach body construction of claim 19 wherein said corner connection means further comprises rotatable clamping plates within said longitudinally extending grooves to which said screw-on corner connections are joined by screws.

21. The coach body construction of claim 18 further comprising:

each said post being formed by two extruded aluminum profiles joined together by longitudinally extending webs; and one of said post profiles extending further than the second of said post profiles where each said post is connected to a respective one of said upper flanges.

22. The coach body construction of claim 18 further comprising:

said longitudinal supports including at least two outer supports;

each of said outer supports having two offset longitudinally extending grooves along an upper surface; and an outer one of said two offset grooves being lower than an inner one of said two offset grooves to increase rigidity and to facilitate mounting of a protective outer cover.

23. The coach body construction of claim 18 further comprising:

said longitudinal supports including at least one inner support; and each said inner support comprising a rectangular hollow profile having two undercut grooves on each side formed by two C-shaped profile fittings with a common central web and two narrow longitudinal sides with a reinforced construction to increase flexural strength.

* * * * *